US007378208B2

(12) United States Patent
Ohmura et al.

(10) Patent No.: US 7,378,208 B2
(45) Date of Patent: May 27, 2008

(54) TONER AND PRODUCTION METHOD OF THE SAME

(75) Inventors: Ken Ohmura, Hachioji (JP); Hiroshi Yamazaki, Hachioji (JP); Asao Matsushima, Hino (JP); Eiichi Yoshida, Hino (JP)

(73) Assignee: Konica Minolta Holdings, Inc. (JP)

( * ) Notice: Subject to any disclaimer, the term of this patent is extended or adjusted under 35 U.S.C. 154(b) by 350 days.

(21) Appl. No.: 10/925,666

(22) Filed: Aug. 24, 2004

(65) Prior Publication Data

US 2005/0196693 A1 Sep. 8, 2005

(30) Foreign Application Priority Data

Mar. 5, 2004 (JP) ..... 2004-061906

(51) Int. Cl.
*G03G 9/08* (2006.01)

(52) U.S. Cl. ..... 430/108.4; 430/111.4

(58) Field of Classification Search ..... 430/108.1, 430/108.6, 108.7, 111.4
See application file for complete search history.

(56) References Cited

U.S. PATENT DOCUMENTS 4,461,822 A * 7/1984 Abele ..... 430/97
5,853,939 A * 12/1998 Yanagibori et al. ..... 430/108.1
6,544,704 B1 * 4/2003 Matsuda et al. ..... 430/108.6
2003/0148204 A1 * 8/2003 Ohmura et al. ..... 430/110.3

FOREIGN PATENT DOCUMENTS

| | | | |
|---|---|---|---|
| JP | 07020652 | A * | 1/1995 |
| JP | 10048867 | A * | 2/1998 |
| JP | 10232505 | A * | 9/1998 |
| JP | 11-133663 | | 5/1999 |
| JP | 2000-172016 | | 6/2000 |
| JP | 2001-022124 | | 1/2001 |
| JP | 2002-148853 | | 5/2002 |
| JP | 2002-333736 | | 11/2002 |
| JP | 2003-005428 | | 1/2003 |

OTHER PUBLICATIONS

Notice of Rejection mailed by JPO on Dec. 11, 2007, in connection with App. No. P2004-031906, 3 pgs.
Translation of Notice of Rejection mailed by JPO on Dec. 11, 2007, 6 pgs.

* cited by examiner

*Primary Examiner*—Christopher RoDee
(74) *Attorney, Agent, or Firm*—Squire, Sanders & Dempsey L.L.P.

(57) ABSTRACT

A toner for an electrophotography comprising a resin and a colorant is disclosed. The toner is formed by a process including a step of aggregating resin particles, and the toner comprises a volatile ketone compound in an amount of 4-60 ppm and carnauba wax in toner particles.

16 Claims, 3 Drawing Sheets

TONER AND PRODUCTION METHOD OF THE SAME

FIELD OF THE INVENTION

The present invention relates to toner which is employed for image formation based on digital systems, and specifically to toner capable of forming toner images which exhibit excellent fixability, particularly onto thick paper, as well as offset printing paper.

BACKGROUND OF THE INVENTION

Image formation employing electrophotographic systems is mainly performed by digital systems. In digital image formation systems, it is essential to use a toner of a minute particle diameter capable of achieving excellent fine line reproduction and high definition, as represented by visualization of images comprised of small dots, for example, at a level of 12,000 dpi (the number of dots per inch).

Further, in Patent Documents 1 and 2, disclosed as an example of production of such a small particle diameter toner is a production method in which toner raw materials such as polyester resins and the like are emulsify-dispersed in a water-based medium and resin particles in the resulting emulsified dispersion are aggregated to the desired toner size.

Further, known as an embodiment of the aforesaid digital image formation, is an image forming method of a print-on-demand system in which the required number of prints are carried out at the required occasions. Image formation utilizing the above system does not necessitate plate making which is performed in conventional printing, and makes it possible to readily achieve production of several hundred copies of publication, as well as production of direct mail and invitation cards while varying mailing addresses. Consequently, the above system is receiving attention as a promising image forming means replacing shortrun printing.

However, it has been noted that problems occur when image formation by the electrophotographic system is employed to produce mail and invitation cards while varying mailing addresses. The problems were that when images were formed on thick paper employed for invitation cards for wedding ceremonies, thick postcards, and gratitude cards for attending a funeral, it was not possible to achieve sufficient fixing. Specifically, in thick postcards and gratitude cards for attending a funeral, provided with a printed gray frame, fixing tends to not be sufficient within the gray frame, resulting in staining of the users' hands and other paper surfaces.

Further, when a toner image is formed on the surface of thick paper, an excessively large load, beyond comparison to that applied onto copy paper sheets, is applied to toner particles. As a result, toner particles tend to be crushed during image formation, whereby problems occur in which the paper surface is stained with powdered toner due to the crushing.

Thick paper such as the aforesaid thick postcards is one of the transfer media with high difficulty. However, in order to increase the use of electrophotography as an image forming means of the print-on-demand system, it is required that toner images are stably formed not only on plain paper developed for electrophotography as recording media, but also on printing paper. If this condition is not satisfied, electrophotography will not be accepted by printing industry.

For example, it is often viewed that a commuter is reading a paperback edition while holding the edition in one hand and hanging on to an overhead strap with the other hand. In such a situation, it is desired that the paper of the edition exhibits lubrication so that pages can be turned only by one hand, and at the same time, toner exhibits the fixing strength so that toner rubbed by friction does not result in staining of the paper surface and the text.

However, the slip property and fixing strength of toner images formed by the electrophotographic system are currently inferior to those of traditional printed matter. As a result, the aforesaid toner images have not been accepted by publishing institutions, resulting in its delayed use. The aforesaid inferiority has not been overcome even by employing toners disclosed in Patent Documents 1 and 2.

Further, toner which is prepared by aggregating resin particles tends to contain a relatively large amount of moisture, since the aggregation is performed in a water-based medium. When such a toner is employed, problems of toner blister are pronounced which is caused by release of toner from a toner image which is formed by generating air bubble formed in such a manner that moisture is evaporated by heat during fixing.

(1) Patent Document 1: Japanese Patent Publication Open to Public Inspection (hereinafter referred to as JP-A) No. 2002-296839 (refer to paragraph 0011)

(2) Patent Document 2: JP-A No. 2002-351140 (refer to paragraph 0011)

DISCLOSURE OF THE INVENTION

An object of the present invention is to provide toner which enables image formation employing the print-on-demand system which performs printing of the necessary number of copies at the required occasion by forming toner images which exhibit excellent fixing strength on the printing paper on which it has been difficult to form images employing conventional toners.

Specifically, a first object is to provide a toner which exhibits excellent fixability without releasing of the toner when toner images are formed on thick paper such as invitation cards or thick postcards, especially when gray halftone images are formed.

Further, a second object is to provide a toner which exhibits excellent fixing strength which results in appropriate slip property and fixing strength equal to common printed matter, when toner images are formed on printing paper for offset printing.

Still further, in the present invention, a third object is provide a toner which exhibits particle strength capable of enduring the load applied to the toner when images are formed on thick paper.

Still further, in the present invention, a fourth object is to provide a toner which does not result in image problems due to toner blisters.

SUMMARY OF THE INVENTION

The present invention and the embodiments thereof will now be described.

A toner comprising resins and colorants, which is formed by aggregating resin particles prepared by addition polymerization or condensation polymerization reaction and comprising carnauba wax and a ketone compound in an amount of 4-60 ppm in toner particles.

It is preferable that the toner comprises a volatile substance in an amount of 20-300 ppm.

It is preferable that resin particles are amorphous polyester resin particles.

It is preferable that the average value of circularity of toner particles is 0.94-0.98, the average value of the equivalent circle diameter is 2.6-7.4 μm, and the slope of the circularity with respect to the equivalent circular diameter is from −0.050 to −0.010.

It is preferable that the aforesaid toner comprises, as an external agent, minute silica or titanium particles of a primary particle diameter of 50-200 nm.

Resins prepared by polyaddition or condensation polymerization reaction of polymerizable monomers are dissolved in solvents, and subsequently, the resulting resinous solution is dispersed into a water-based medium.

Figure 1:
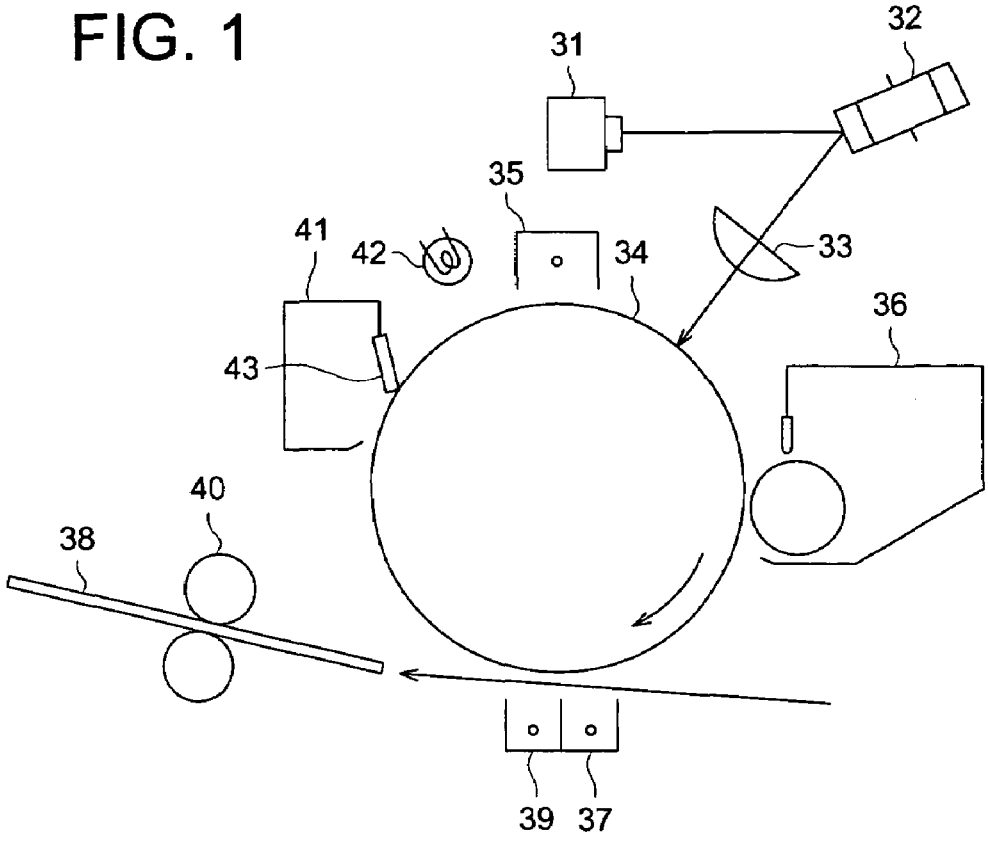
FIG. 1 is a cross-sectional constitutional view showing one example of an image forming apparatus which employs the toner according to the present invention.

The inventors of the present invention discovered the following: In the case in which images were formed employing a toner which is formed via a process in which resin particles prepared by polyaddition or condensation polymerization reaction were aggregated and which comprised carnauba wax as a releasing agent as well as volatile components comprised of ketone compounds in an amount of 4-60 ppm, when images were formed, for example, on relatively thick paper such as a wedding invitation card, halftone images were securely fixed. Further, the inventors of the present invention discovered that when images were formed on paper for offset printing, it was possible to prepare toner images which exhibited excellent slip property as well as sufficient fixing strength.

In addition, it was also discovered that no problems due to unpleasant odor from volatile components occurred during formation of images employing the aforesaid toner and from prepared images, and even though a large load is applied to the toner during image formation, image problems due to formation of powdered toner formed by crushing toner particles, as well as due to toner blisters, were minimized.

Reasons are not yet clarified why the toner according to the present invention exhibits excellent fixability even though toner images are formed on very thick paper. It is assumed that carnauba wax and a ketone compound incorporated into toner particles contributes to enhancement of fixability in any form.

Namely, the following is assumed: Ketone compound reacts with a hydroxyl group on the surface of transfer paper comprised of cellulose, whereby chemical bonds are formed. Alternatively, carnauba wax and a ketone compound enters into the spaces between cellulose fibers which constitute transfer paper, and function as an adhesive between the transfer paper and the toner to enhance the adhesion strength between the toner image and the transfer paper, whereby such facts contribute to enhancement of fixability.

Specifically, in the case in which a large member of images is formed at a high rate, the temperature of the surface of transfer paper reaches approximately 125° C. due to heat from a heating roller. Consequently, it is assumed that during the period while the temperature of the transfer sheet is lowered to room temperature, the reaction of a ketone compound with the hydroxyl group on the surface of the transfer sheet is accelerated, or a ketone compound migrates to the exterior of toner particles and are adsorbed into the space between fibers.

On the other hand, one worrying problem is that in incorporated ketone compound results in peculiar unpleasant odors during fixing and image forming materials comprising a ketone compound generate the same unpleasantness. However, in the present invention, when the amount of the ketone compound in toner particles is in the specified range, fixability is improved without resulting in unpleasant odor.

Further, in the case in which images are formed on both sides, when one transfer paper sheet is brought into contact with another one before both are cooled, problems of so-called tacking in which toner images slightly adhere to each other are concerned. However, when the toner of the present invention was employed, no tacking was noted.

In the present invention, it is assumed that adhesion strength between the toner particles and the paper is enhanced by the action of the ketone compound incorporated into the toner particles. As noted above, enhancement of the fixing strength of toner particles on the transfer paper is effective for image formation employing small diameter toner particles which have made it difficult to achieve sufficient fixing strength due to less contact area between the toner particles and the transfer paper.

Further, in the case in which toner images are formed on thick paper, even though a large load is applied to toner particles, the toner particles exhibit stable particle strength so that they are not destroyed. It is assumed that the strength of toner particles is improved due to the fact that releasing agent regions comprised of carnauba wax in a toner particle absorb impact applied to the toner, and a ketone compound in the toner provide adhesion property to the interface between the resin phase and the releasing agent phase.

As noted above, the toner of the present invention is capable of providing high strength to toner particles as well as resulting in strong negative electrification property. Consequently, the toner according to the present invention is particularly suitable for image formation employing a non-magnetic single-component toner.

The reasons for the toner according to the present invention exhibiting strong negative electrification property are assumed as follows. Resins such as polyester resins, polyol resins, or polyurethane resins exhibit strong electrification property, and since rounded toner particles easily undergo autorotation, triboelectrification is efficiently enhanced.

According to the present invention, when images are formed on thick paper such as invitation cards or thick postcards, or on offset printing paper, employing toner containing carnauba wax as well as volatile components comprised of a ketone compound in an amount of 4-60 ppm, it was confirmed that it was possible to prepare toner images which exhibited excellent fixing strength, as well as resulted in neither generation of unpleasant odor nor blistering problems.

As a result, it has become possible to form toner images on thick paper as well as on offset printing paper, while it was impossible to do so employing conventional techniques. Replacing the conventional printing in which plate-making was required even for a small production of books, it has made it possible to provide book production based on the print-on-demand system which is a book production system in which images are outputted based on the number of desired sheets at the desired time.

DETAILED DESCRIPTION OF THE INVENTION

The present invention relates to a toner which is prepared in such a manner that resin particles are formed employing a polyaddition or condensation polymerization reaction, and carnauba wax and a ketone compound in an amount of 4-60 ppm are incorporated in toner particles which are prepared by aggregating the aforesaid resin particles. The toner according to the present invention will now be detailed.

<Polyaddition Reaction and Condensation Polymerization Reaction>

Resins which constitute the toner according to the present invention are prepared employing a polyaddition or condensation polymerization reaction.

As used herein, the term "condensation polymerization reaction" refers to a reaction in which compounds having a plurality of functional groups successively undergo repeated condensation reaction to form a polymer, while releasing low molecular weight compounds such as water or alcohols. Generally, listed as well known examples of the condensation polymerization reactions are, for example, a reaction in which polyamide (nylon 66) is prepared by allowing hexamethylenediamine to react with adipic acid while releasing water, and a reaction in which polyester (polyethylene terephthalate) is prepared by allowing ethylene glycol to react with terephthalic acid ester with the release of alcohol.

On the other hand, as used herein, the term "polyaddition reaction" refers to a reaction in which new bonds are formed by undergoing an addition reaction among functional groups of the compound having a functional group and the aforesaid reaction is successively repeated to form a polymer. The polymer is formed without releasing low molecular compounds during the reaction, which occurs in the condensation polymerization reaction.

As noted above, the polyaddition reaction proceeds in such a manner that the reaction among the functional groups is successively repeated, and consequently differs from addition polymerization reactions such as radical polymerization. Commonly listed as examples of the polyaddition reaction is one in which polyurethane is formed, for example, from hexamethylene diisocyanate and tetramethylene glycol.

<Carnauba Wax>

The toner according to the present invention comprises carnauba wax, which is Carnauba wax is natural wax, prepared by purifying the product obtained from palm trees called Pelmeria de carnauba and exhibits excellent characteristics such as glossiness, emulsification, water repellence, and water resistance.

Carnauba wax is prepared in such a manner that wax components are liberated from leaves and stalks of the aforesaid palm trees and purified by removing impurities while heated and melted. Carnauba wax employed as a releasing agent for toners include the following: the highest grade natural product which is prepared in such a manner that young leaves of palm trees, which are not fully unfolded, are cut, collected, dried, and crushed by beating, and wax components are liberated from plant veins; a product which is prepared in such a manner that low grade carnauba wax which is prepared by extracting wax components from fully unfolded leaves, fallen leaves and stalks of palm trees while removing impurities and subsequently is subjected to quality improvement employing the method disclosed in Japanese Patent Publication No. 2681097; and a product which is repeatedly purified employing a molecular distillation method.

In regard to physical properties of carnauba wax employed in the toner according to the present invention, its acid value is commonly at most 10.0, is preferably 0.1-8.0, and is more preferably 0.4-6.0. Carnauba wax having the lower acid value does not form insoluble products with metal salts which are added during preparation of the toner. As a result, the aggregating property of resin particles is preferably stabilized to result in a narrow particle size distribution.

Further, the saponification value of carnauba wax is controlled preferably to 70-95, more preferably to 75-90, and most preferably 78-95. By preparing carnauba wax to have such saponification value, it is capable of functioning as a releasing agent in toner particles, as well as functioning as a surface active agent.

Physical properties of carnauba wax such as acid value and saponification value are determined employing the commonly well known methods disclosed as test methods based on the Standard Oil and Fat Test Method and Japanese Pharmacopoeia 13th Revised Edition D-18.

Further, the melting point is commonly 75-90° C., and is preferably 80-88° C. The above melting point is determined employing well known methods based on the aforesaid methods or DSC.

The dynamic viscosity at 100° C. determined employing a Brookfield type rotating viscosimeter is commonly 15-35 cps, is preferably 20-30 cps, and is more preferably 22-28 cps.

The iodine value is commonly 5-14, and is preferably 8-12, while the penetration is preferably a maximum of 1.0, which is determined employing the method specified in JIS K 2235-1991.

Further, it is preferable that the carnauba wax employed in the toner according to the present invention comprises a paraffin hydrocarbon composition of 1-3 percent by weight, a resinous composition of 1.5-5.5 percent by weight, and benzene-soluble components of 4-12 percent by weight. These compositions enhance the slip property of toner images at lower temperature. These compositions are determined based on the above-mentioned Standard Oil and Fat Test Method and Japanese Pharmacopoeia 13th Revised Edition D-18.

Carnauba wax may be in the form of flakes, granules, powder, or an emulsion type formed by emulsification. Specifically, in view of production of toner, and due to the fact that the solubility of powdered products tends to be degraded due to aerial oxidation during storage, flakes are preferred so that the original performance of carnauba wax is exhibited.

Carnauba wax may be mixed with other waxes described below and then employed.

In the present invention, depending on the degree of purification of carnauba wax, it is possible to control the content of a volatile ketone compound in the toner particles, described below. Listed as a purification method of carnauba wax is a molecular distillation method in which impurities are evaporated and removed by flash heating in a high vacuum. Incidentally, practical purification techniques employing the molecular distillation method applicable to the carnauba wax employed in the present invention are disclosed, for example, in JP-A 11-209785.

The amount of carnauba wax incorporated in the toner according to the present invention is customarily 1-30 percent by weight, is preferably 2-20 percent by weight, and is more preferably 3-15 percent by weight. Specifically, the endotherm by carnauba wax in which toner is measured employing DSC is customarily 4-24 J/g, is preferably 5-15 J/g, and is more preferably 6-12 J/g.

The carnauba wax or a volatile ketone compound containing carnauba wax can be incorporated in the toner in the following way.

The wax is dissolved or dispersed in monomer solution and the wax containing monomer is polymerized to prepare resin particles.

The wax is dispersed with resin particles and they are coagulated to prepare toner particles.

<<Ketone Compound>>

The toner according to the present invention comprises a ketone compound in an amount of 4-60 ppm in the toner particles. As used herein, the term "ketone compound" denotes the compounds represented by the Structural Formula (1) below.

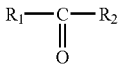

Formula (1)

wherein $R_1$ and $R_2$ each represent an alkyl group having 1-25 carbon atoms, which may have a substituent, an alkylene group, or a phenyl group.

In regard to toner, a ketone compound may be added to carnauba wax which is incorporated into the toner, or may be directly added to the toner particles.

A ketone compound incorporated in the toner are quantitatively analyzed, employing for example, a head space system gas chromatograph. In this method, it is possible to determine the above amount employing detection methods such as the internal standard method commonly employed in gas chromatography.

In the quantitative analytical method employing gas chromatography based on the head space system, toner is placed in a sealed vessel which is heated to approximately the thermal fixing temperature in copiers. When the vessel is filled with volatile components, the resulting gas in the vessel is quickly injected into gas chromatograph, whereby volatile components are analyzed and MS (mass analysis) is also performed.

The head space gas chromatographic measurement method will now be described.

<Head Space Gas Chromatographic Measurement Method>

1. Sampling Samples

Charged in a 20-ml vial for head space is 0.8 g of a sample. The weight of the sample is measured to the second decimal of 0.01 (since it is necessary to calculate the area per unit weight). The vial is sealed with a septum.

2. Heating Samples

Samples are placed in a thermostat at 170° C. so that each vial remains erect and are heated for 30 minutes.

3. Setting of Gas Chromatograph Separation Conditions

A column having an inner diameter of 3 mm and a length of 3 m, filled with carriers which are coated with silicone oil SE-30 so as to achieve a weight ratio of 15 is employed as a separation column. The resulting separation column is installed in the gas chromatograph, and He, as a carrier, is allowed to flow at a rate of 50 ml/minute. The separation column is heated to 40° C. and subsequently measurements are carried out while raising the temperature to 200° C. at a rate of 10° C./minute. After reaching 200° C., the temperature is maintained for 5 minutes.

4. Introduction of Sample

The vial is removed from the thermostat, and immediately 1 ml of gas, generated from the sample, is collected employing a gas tight syringe. Subsequently, the collected gas is injected into the above mentioned column.

5. Calculation

In advance, a calibration curve is prepared employing an organic silanol compound utilized as an inner standard material. The concentration of each component is determined based on the corresponding calibration curve.

6. Apparatus and Material (1) Head Space Conditions

Head Space Apparatus

HP7694 "Head Space Sampler" manufactured by Hewlett-Packard Corp.

Temperature Conditions

Transfer line: 200° C.

Loop temperature: 200° C.

Sample Amount: 0.8 g/20 ml vial (2) GC/MS Conditions

GC: HP5890 manufactured by Hewlett-Packard Corp.

MS: HP5971 manufactured by Hewlett-Packard Corp.

Column: HP-624, 30 m×0.25 mm

Oven temperature: 40° C. (maintained for 3 minutes)—rising 10° C./minute—to 200° C.

Measurement mode: SIM

The content of a ketone compound refers to a value obtained in such a manner that organic compounds in the gas phase, formed when the toner is heated at 170° C. for 30 minutes, is converted to the amount of toluene.

It is preferable that benzophenone in an amount of 1-10 ppm is detected as the ketone compound in the toner. Benzophenone is not commonly detected by analyzing single carnauba wax. Consequently, it is assumed that benzophenone is formed in such a manner that any residual substances in the carnauba wax undergo reaction by the action of heat during production of the toner such as in an aggregation process.

In the toner according to the present invention, the content of the ketone compound is customarily 4-60 ppm, and is preferably 6-45 ppm. It is possible to control the amount of the ketone compound incorporated in the toner depending on the degree of purification of the carnauba wax. Specifically, as the frequency of the molecular distillation process increases, the degree of purification of the carnauba wax is enhanced, whereby the content of the ketone compound decreases.

The toner according to the present invention comprises, other than the above ketone compound, volatile components such as ethyl acetate, butanol, and/or xylene due to the production process of resin particles, and the content of the total volatile components is 20-300 ppm.

As a specific measurement result, it is preferable that detected are ethyl acetate in an amount of 0.5-24 ppm, butanol in an amount t of 0.5-28 ppm, and xylene in an amount of 0.1-30 ppm.

The shape of the toner particle is described below.

The shape of the toner particle according to the invention has the average value of the circular degree (the shape coefficient) represented by the following equation of from 0.94 to 0.99, more preferably from 0.94 to 0.98, and further preferably from 0.94 to 0.97. The average circular degree is determined concerning 2000 toner particles each having the diameter of not less than 1 μm.

Circular degree=(Periphery length of equivalent circle)/(Periphery length of projection image of toner particle)=$2\pi\times$(Projection area of particle/$\pi)^{1/2}$/(Periphery length of projection image of toner particle)

Wherein, the equivalent circle is a circle having an area the same as that of the projection image of the toner particle, and the circle equivalent diameter is the diameter of the equivalent circle.

The circular degree can be measured by FPIA-2000, manufactured by Sysmex Corporation. The equivalent circle diameter id defined by the following equation.

Equivalent circle diameter=$2\times$(Projection area of particle/$\pi)^{1/2}$

In the shape of the toner according to the invention, the average of the equivalent circle diameter is from 2.6 to 7.4 μm and the inclination of the circular degree to the equivalent circle diameter is from −0.050 to −0.010. More preferably, the average of the equivalent circle diameter is from 3.4 to 6.6 μm and the inclination of the circular degree to the equivalent circle diameter is from −0.040 to −0.020.

Particles each having relatively high weight and low circular degree is transferred wedge wise and particles each having a smaller diameter and high circular degree are transferred so as to fill up the gaps between the larger particles and make the closest packing status for forming an image. The toner particles are sintered with together when such the image is fixed and satisfactory fixing strength can be obtained. Such the effect is insufficient when the circular degree and the equivalent circle diameter of the particle scatteringly distribute.

It has been found that the sufficient fixing strength can be obtained on the thick paper by continuously changing the circle equivalent diameter and the circular degree according to the inclination of the circular degree to the circle equivalent diameter.

The inclination of the circle equivalent diameter is defined by α in the primary correlation ($y=\alpha x+b$) of the relation between the circle equivalent diameter (μm) taken on the horizontal axis and the circular degree taken on the vertical axis, the circle equivalent diameter of the toner particle is measured by a flow type particle image analyzing apparatus FPIA-2000.

For improving the uniformity of electrical charge and that of the halftone image, $R^2$ (squared R) is preferably from 0.35 to 0.95. R is defined by the following formula.

$$R=A/B \qquad \text{Equation 1}$$

In the above, A and B are each defined by the following formulas.

$$A=n\Sigma XY-(\Sigma X\Sigma Y)$$

$$B=(n\Sigma X^2-(\Sigma X)^2)\times(\ (n\Sigma Y^2)-(\Sigma Y)^2)$$

Wherein, X is circle equivalent diameter in μm, and Y is the circular degree.

Small diameter toner particles may be mixed with toner particles having a different shape and a lager diameter in some degree to prepare the toner having the inclination of circle equivalent diameter. In the later-mentioned method for producing the toner particles by aggregating resin particles, a method may be applied in which the stirring strength is controlled after addition of the aggregating agent by suitably selecting the shape of the stirring propeller so that the shearing force is easily applied to larger particles, and the resulted particles are filtered and dried. It is preferable that the toner producing apparatus is connected inline to the foregoing flow type particle image analyzing apparatus and the production is performed while monitoring the inclination a and suitably controlling the production conditions according to the result of the monitoring.

The shape of the toner particle can be controlled so as to be within the range of the invention when the particle is grown further 0.2 to 1.0 μm by re-addition of the aggregating agent or additional addition of a surfactant after the addition of the aggregating agent.

Binder Resin

A binder resin forming toner particles is described.

A binder resin used for forming toner particles in an aqueous medium is preferably used as the binder resin. The resin is preferably prepared by addition polymerization or condensation polymerization reaction.

For example, an amorphous polyester resin, a urethane modified polyester resin, a polyol resin, a polyurethane resin and an epoxy resin can be cited as the typical material.

The amorphous polyester is resin in which polyester molecular having no clear crystal structure accounts for not less than 50 mole-percent of the whole resin constituting the toner. In more detail, the amorphous polyester is resin in which the molecules having a crystallization degree of less than 0.1% account for not less than 50 mole-percent.

The crystallization degree is determined by density, heat of fusion, X-ray diffraction, or NMR (Nuclear Magnetic Resonance spectrum), and expressed by weight percentage of the crystallized domain.

Amorphous Polyester Resin

Examples of polyvalent carboxylic acid to be used for the polyester resin include an aromatic dicarboxylic acid such as terephthalic acid, iso-phthalic acid, ortho-phthalic acid, 1,5-naphthalene-dicarboxylic acid, 2,6-naphthalene-dicarboxylic acid, diphenic acid, sulfoterephthalic acid, 5-sulfoisophthalic acid, 4-sulfophthalic acid, 4-sulfonaphthalene-2,7-dicarboxylic acid, 4-slfophthalic acid, 5[4-sulfophenoxy] isophthalic acid and their metal or ammonium salts, an oxycarboxylic acid such as p-oxy-benzoic acid and p-(hydroxyethoxy)benzoic acid, an aliphatic dicarboxylic acid such as succinic acid, adipic acid, azelaic acid, sebacic acid, and dodecane dicarboxylic acid, an unsaturated carboxylic acid such as fumaric acid, maleic acid, itaconic acid, hexahydrophthalic acid, and tetrahydrophthalic acid, and an alicyclic dicarboxylic acid. Other than the above, a tri- or more valent carboxylic acid such as trimellitic acid, trimesic acid and pyromellitic acid can be exemplified.

As the aliphatic poly-valent alcohol, 1,4-cyclohexane diol, 1,4-cyclohexane dimethanol, spiro glycol, hydrogenated bis-phenol A, ethylene oxide adducts of hydrogenated bis-phenol A, bis-phenol A, and ethylene oxide adducts or propylene adducts of bis-phenol A, tricyclodecane diol and tricyclodecane methanol can be exemplified.

As the aromatic poly-valent alcohol, para-xylene glycol, meta-xylene glycol, ortho-xylene glycol, 1,4-phenylene glycol, ethylene glycol adducts of 1,4-phenylene glycol, bis-phenol A, and ethylene oxide adducts of bis-phenol A can be exemplified. As the polyester polyol, lactone type polyester polyols can be exemplified, which are obtained by ring opening polymerization of lactones such as ϵ-caprolactone.

Preferable example of polyester resin includes alcohol component in combination of bisphenol A propylene oxide and bisphenol A ethylene oxide in a ratio of 6:4 to 8:2, and acid component in combination of terephthalic acid, trimellitic acid and 1,6-hexamethylenedicarboxylic acid in a ratio of 8:1:1.

A mono-functional monomer may be introduced into the polyester for improving the stability regarding the atmosphere of the charging property of the toner by blocking the polar group being at the terminal of the polyester molecular. Examples of the usable mono-functional monomer include mono-carboxylic acids such as benzoic acid, chlorobenzoic acid, bromobenzoic acid, p-hydroxybenzoic acid, mono-ammonium sulfobenzoate, mono-sodium sulfobenzoate, cyclohexylaminocarbonylbenzoic acid, n-dodecylaminocarbonylbenzoic acid, t-butylbenzoic acid, naphthalene carboxylic acid, 4-methylbenzoic acid, 3-methylbenzoic acid, salicylic acid, thiosalycilic acid, phenylacetic acid, acetic acid, propionic acid, lactic acid, iso-lactic acid, octane carboxylic acid, lauric acid, stearic acid, and low alkyl esters of them, and mono-alcohols such as aliphatic alcohols, aromatic alcohols, and alicyclic alcohols.

(Urethane Modified Polyester)

The amorphous polyester resin used in this invention may be urethane modified polyester containing urethane bond in molecular structure and modified in view of giving sufficient mechanical strength and preventing crashing. The urethane modified polyester is detailed.

Polyester modified with a urethane bond (i) includes such as reaction products of polyester prepolymer (A) provided with an isocyanate group and an amine series (B). Polyester prepolymer (A) provided with an isocyanate group includes polyester which is prepared by polycondensation of the aforesaid polyhydric carboxylic acid series with a polyhydric alcohol series, and further provided with an active hydrogen group further reacted with a polyisocyanate.

The active hydrogen group of the aforesaid polyester includes a hydroxyl group (an alcoholic hydroxyl group and a phenolic hydroxyl group), an amino group, a carboxyl group and a mercapto group, but preferable among these is the alcoholic hydroxyl group.

Polyisocyanate includes aliphatic polyisocyanate (such as tetramethylene diisocyanate, hexamethylene diisocyanate and 2,6-diisocyanate methylcaproate); alicyclic polyisocyanate (such as isophorone diisocyanate and cyclohexylmethane diisocyanate); aromatic diisocyanate (such as tolylene diisocyanate and diphenylmethane diisocyanate); aromatic aliphatic diisocyanate (such as α, α, α', α'-tetramethylxylene diisocyanate); an isocyanurate series; the aforesaid polyisocyanate having been blocked with such as a phenol derivative or caprolactam; as well as combinations of two or more types thereof.

The polyisocyanate ratio is generally 5/1-1/1, preferably 4/1-1.2/1 and furthermore preferably 2.5/1-1.5/1, based on an equivalent ratio [NCO]/[OH] of an isocyanate group [CNO] to a hydroxyl group [OH] of polyester provided with a hydroxyl group.

The fixing property at low temperature is deteriorated when [NCO]/[OH] is over 5. The urethane content in modified polyester is reduced and resistance to hot offset is degraded when the mole ratio of [NCO] is less than 1. The content of a component constituting polyisocyanate in a prepolymer, the ending terminal of which is provided with an isocyanate group (A), is generally 0.5-40 weight %, preferably 1-30 weight % and more preferably 2-20 weight %.

The number of an isocyanate group contained per one molecule of a prepolymer provided with an isocyanate group (A) is generally at least 1, preferably 1.5-3 and more preferably 1.8-2.5, based on average numbers.

An amine series includes such amines as diamine, tri- or higher polyamine, aminoalcohol, aminomercaptan, amino acid, and these amino groups which are blocked.

Diamine includes aromatic diamines (such as phenylenediamine, diethyltoluenediamine and 4,4'-diaminodiphenylmethane); alicyclic diamines (such as 4,4'-diamino-3,3'-dimethylcyclohexylmethane, diamine cyclohexane and isophorone diamine);and aliphatic diamines (such as ethylenediamine, tetramethylenediamine and hexamethylenediamine).

Polyamines not less than trivalent include such as diethylenetriamine and triethylenetetramine.

Aminoalcohols include compounds such as ethanolamine and hydroxyethylaniline. Aminomercaptans include such as aminoethylmercaptan and aminopropylmercaptan. Amino acids include aminopropionic acid and aminocapronic acid.

The amino groups which are blocked include ketimine compounds and oxazoline compounds prepared from an amine series and ketone compounds (such as acetone, methyl ethyl ketone and methyl isobutyl ketone) of aforesaid amines. Among these amine series, preferable is diamine and a mixture of diamine with a small amount of polyamine trivalent or more.

Further, the molecular weight of urethane modified polyester can be controlled by appropriately utilizing an extension terminator. An extension terminator includes such as monoamines such as diethylamine, dibutylamine, butyl amine and laurylamino, and blocked compounds thereof such as ketimine compounds.

The ratio of an amine series is generally 1/2-2/1, preferably 1.5/1-1/1.5 and more preferably 1.2/1-1/1.2, based on the equivalent ratio of an isocyanate group [NCO] in prepolymer provided with an isocyanate group to an amino group [NHx] in amine series: [NCO]/[NHx].

Urethane modified polyester is prepared by means of a one-shot method or a prepolymer method. The weight average molecular weight of urethane modified polyester is generally at least 10,000, preferably 20,000-10,000,000 and more preferably 30,000-1,000,000.

The number average molecular weight of urethane polyester is not specifically limited when non-modified polyester is utilized, and may be any number average molecular weight which can be easily be obtained to obtain the aforesaid weight average molecular weight. The number average molecular weight is generally at most 20,000, preferably 1,000-10,000 and more preferably 2,000-8,000 when urethane modified polyester is utilized alone, in view of low temperature fixing property and glossiness of image.

In this invention, polyester resin not being modified with a urethane bond and polyester modified with such as a urethane bond may be also utilized in combination as a binder resin. The low temperature fixing property and glossiness in the case of being employed in a full color apparatus are improved by incorporation of modified urethane polyester, resulting in being superior to utilization of alone.

As modified urethane polyester, listed are polycondensation compounds of polyol and polycarboxylic acid similar to the aforesaid polyester component. Preferable compounds are also those similar to polyester resin having not urethane modified. Further, polyester resin having not urethane modified may be not only amorphous polyesters but also those modified with a chemical bond other than a urethane bond.

Combination of polyester resin having not urethane modified and urethane modified polyester resin is preferably at least partly dissolved in each other, with respect to achieving a low temperature fixing property and resistance to hot offset. Therefore, polyester components of the polyester resin not urethane modified and urethane modified polyester resin preferably have a similar composition.

In the case of incorporating urethane modified polyester resin, the weight ratio of polyester resin having not urethane modified to urethane modified polyester resin is generally 5/95-80/20, preferably 5/95-30/70, more preferably 5/95-25/75 and specifically preferably 5/95-20/80, in view of compatibility of tropical heat storage stability and a low temperature fixing property, and resistance to hot offset.

A peak molecular weight of urethane modified polyester resin is generally 1,000-30,000, preferably 1,500-10,000 and more preferably 2,500-9,500, in view of good tropical heat storage stability and a low temperature fixing property. Mw/Mn, a ratio of weight average molecular weight Mw to number average molecular weight Mn, is preferably 1.5 to 4.5.

The hydroxyl value of polyester resin not urethane modified is preferably at least 5, more preferably 10-120 and specifically preferably 20-80, in view of compatibility of tropical heat storage stability and a low temperature fixing property.

The acid value of urethane modified polyester resin is generally 1-30 and preferably 5-20, in view of good negative charging property by providing an acid value.

<Polyol Resin, Epoxy Resin>

Polyol resin and epoxy resin utilized in this invention will now be explained.

Various types of resin may be utilized as polyol resin, however, the following are specifically preferred in this invention. Preferably utilized are polyols prepared by reacting epoxy resin, an alkyleneoxide adduct of dihydric phenol or glycidyl ether thereof, with a compound having at least two reactive hydrogen atoms which react with an epoxy group in the molecule. Further, specifically preferable epoxy resins are at least two types of bisphenol A type epoxy resins having different number average molecular weights. These polyols are effective for providing excellent glossiness and transparency as well as resistance to offset.

Epoxy resins utilized in this invention are preferably those prepared by combining bisphenols such as bisphenol A and bisphenol F with epichlorohydrin. Epoxy resin is preferably comprised of at least two types of bisphenol A type epoxy resins having different number average molecular weights; the number average molecular weight of the lower molecular weight component being 360-2,000 and the number average molecular weight of the higher molecular weight component being 3,000-10,000 which achieve stable fixing characteristics and glossiness. Further, the lower molecular weight component is preferably contained in the range of 20-50 weight %, and the higher molecular weight component is preferably contained in the range of 5-40 weight %, with respect to good glossiness and property.

As compounds utilized in this invention, that is, as alkyleneoxide adducts of dihydric phenols, listed are the following. Listed are reaction products of ethyleneoxide, propyleneoxide, butyleneoxide and mixtures thereof, with bisphenols such as bisphenol A and bisphenol F. The prepared adducts may be glycidylized by use of epichlorohydrin or β-methylepichlorohydrin. Specifically, preferred are diglycidyl ether of alkyleneoxide adducts of bisphenol A, represented by following general formula (2).

General Formula (2)

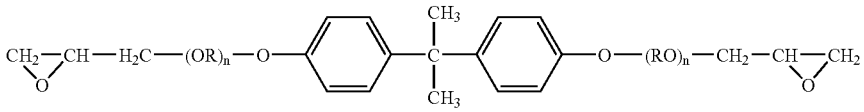

(wherein, R is

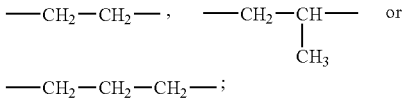

n and m are numbers of a repeating unit and being at least 1, and "n+m" is from 2 to 6.)

Further, an alkyleneoxide adduct of dihydric phenol or glycidyl ether thereof is preferably contained at 10-40 weight % based on polyol resin with respect to inhibiting curling.

In case that sum of m and n is 2 to 6, glossiness and store ability are compatible.

Compounds having one reactive hydrogen atom which reacts with an epoxy group in the molecule are a monohydric phenol series, a secondary amine series and a carboxylic acid series. As a monohydric phenol series, exemplified are the following. Listed are such as phenol, cresol, isopropylphenol, aminophenol, nonylphenol, dodecylphenol, xylenol and p-cumylphenol.

As a secondary amine series, listed are diethylamine, diopropylamine, dibutylamine, N-methyl(ethyl)piperazine and piperidine. Further, as carboxylic acid series, listed are propionic acid and caproic acid.

To prepare polyol resin of this invention provided with an epoxy resin portion and an alkyleneoxide portion in the main chain, various combinations of raw materials are possible. For example, it can be prepared by reacting epoxy resin having glycidyl groups on both ends and an alkyleneoxide adduct of a dihydric phenol having glycidyl groups on both ends with dihalide diisocyanate, diamine diol polyhydric phenol or dicarboxylic acid. Among them with respect to reaction stability preferred is to react a dihydric phenol.

Further, it is also preferable to utilize a polyphenol series and a polybasic carboxylic acid series together with dihydric phenol. Herein, the amount of a polyhydric phenol series or a polybasic carboxylic acid series is generally at most 15% but preferably at most 10% based on the total amount.

A compound provided with two or more reactive hydrogen atoms which react with an epoxy group in the molecule includes a dihydric phenol series, a polyhydric phenol series, and a polybasic carboxylic acid series. As dihydric phenol, listed are bisphenols such as bisphenol A and bisphenol F. As a polyhydric phenol series, exemplified are an orthocresol novolak series, a phenol novolak series, tris(4-hydroxyphenyl)methane and 1-[α-methyl-α-(4-hydroxyphenyl)ethyl] benzene.

As a polybasic carboxylic acid series, exemplified are malonic acid, succinic acid, glutaric acid, adipic acid, maleic acid, fumaric acid, phthalic acid, terephthalic acid, trimellitic acid and trimellitic acid anhydride.

Further, these polyester resins or polyol resins preferably provided with no cross-linking or at least weak cross-linking (being at most 5% of the THF insoluble portion), because transparency or glossiness are barely obtained when it is provided with a high cross-linking density.

A toner production method may comprise a process in which in the resulting dispersion, resin particles, formed by removing droplets of the aforesaid resinous solution or solvents, are aggregated.

Colorant

As the colorant, various kinds of inorganic pigment, organic pigment and dye are usable.

Concrete examples of the inorganic pigment are listed below.

As a black pigment employed in preparation of black toner, for example, carbon black such as furnace black, channel black, acetylene black, thermal black, and lampblack, and a magnetic particle such as magnetite and ferrite are usable.

The inorganic pigments may be used singly or in combination of suitably selected ones. The adding amount of the inorganic pigment is from 2 to 20%, and preferably from 3 to 15%, by weight to the whole toner weight.

The magnetite may be added when the toner is used as a magnetic toner. In such the case, it is preferable that the adding amount is from 20 to 120% by weight for giving suitable magnetic properties.

Concrete examples of the organic pigment and the dye are show below.

As the pigment of magenta or red, the followings are exemplified: C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 122.

As the orange or yellow pigment, the followings are exemplified: C. I. Pigment Orange 31, C. I. Pigment Orange 43, C. I. Pigment Yellow 12, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155, and C. I. Pigment Yellow 156.

As the green or cyan pigment, the followings are exemplified: C. I. Pigment Blue 15, C. I. Pigment Blue 15:2, C. I. Pigment Blue 15:3, C. I. Pigment Blue 16, C. I. Pigment Blue 60, and C. I. Pigment Green 7.

As the dye, the followings are usable: C. I. Solvent Red 1, 49, 52, 58, 63, 111, and 122, C. I. Solvent Yellow 19, 44, 77, 79, 81, 82, 93, 98, 103, 104, 112, and 162, and C. I. Solvent Blue 25, 36, 60, 70, 93, and 95. A mixture of them is also usable.

These pigments and dyes may be used singly or in combination of suitably selected ones. The adding amount of the pigment is from 1 to 20% by weight to the whole weight of the toner.

Releasing Agent Employed in Combination with Carnauba Wax

A releasing agent, which can be dispersed in a water-based medium, can be used in addition to carnauba wax in this invention. Practical example includes olefin series wax such as polypropylene and polyethylene, denaturalized olefin series wax, natural wax such as rice wax, amide series wax such as aliphatic acid bisamide, aliphatic acid wax, aliphatic mono-ketone compound, aliphatic acid metal salt wax, aliphatic acid ester wax, partially saponified aliphatic acid ester wax, and higher alcohol wax.

Preferable examples are ester compounds represented by the following formula (3).

$$R_1—(OCOR_2)_n \qquad \text{Formula (3)}$$

In the formula, $R_1$ and $R_2$ are each a carbon hydride group which may have a substituent, n is an integer of from 1 to 4.

The number of the carbon atoms of $R_1$ is preferably 1 to 40, more preferably from 1 to 20, and further preferably from 2 to 5.

The number of the carbon atoms of $R_2$ is preferably 1 to 40, more preferably from 16 to 30, and further preferably from 18 to 26.

In Formula (3),n is an integer of from 1 to 4, preferably from 2 to 4, further preferably from 3 to 4, and most preferably 4.

The ester compound can be synthesized by dehydration condensation reaction of alcohol and carboxylic acid. Practical examples of the ester compound are described in JP O.P.I. Publication No. 2002-214821.

Charge Controlling Agent

Toners of this invention may contain a charge control agent. Examples of the charge controlling agent include nigrosine type dyes, triphenylmethane type dyes, chromium-containing metal complex dyes, molybdate chelate pigments, Rhodamine type dyes, alkoxyl amines, quaternary ammonium salts including fluorine-modified quaternary ammonium salts, alkylamides, elemental phosphor and its compounds, elemental tungsten and its compounds, fluorine-containing surfactants, metal succinate and metal salts of succinic acid derivative.

In concrete, nigrosine type dye Bontron 03, quaternary ammonium salt Bontron P-51, azo type metal complex compound Bontron S-34, oxynaphthoic type metal complex E-89, salicylic acid type metal complex E-84, and phenol type condensation product E-89, each produced by Orient Chemical Industries, Ltd., quaternary ammonium salt molybdenum complex TP-302 and TP-415, each produced by Hodogaya Chemical Co., Ltd., quaternary ammonium salt Copycharge PYS VP2038, triphenylmethane derivative Copyblue PR, quaternary ammonium salt Copycharge NEGVP2036, and Copycharge NX V434, each produced by Hoechst CO., Ltd., LRA-901, and boron complex LR-147, each produced by Japan Carlit Co. Ltd., copper phthalocyanine, perylene, quinacridone, azo type pigments, and polymers having a functional group such as a sulfonic acid group, a carboxyl group and quaternary ammonium salt group.

Among them, azo type metal complex compounds are preferred. For example, ones disclosed in paragraph 0009 to 0012 of JP O.P.I. Publication No. 2002-351150 are preferably used.

In the invention, the charge controlling agent is preferably used in an ratio of from 0.1 to 10 parts by weight to 100 parts by weight of the binder resin even though the amount of the agent cannot be simply decided since the amount is determined depending on the kind of the binder resin, presence of additive to be added according to necessity, and the producing process of the toner including the dispersing method.

In the invention, it is preferable to add the charge controlling agent to near the surface of the toner particle. The charging property can be effectively given to the toner particle and the flowing ability of the toner can be maintained by adding the charge controlling agent to near the surface of the toner particle since the charge controlling agent is added so that the charge control agent is not exposed to the toner surface.

As the practical method to incorporate the charge controlling agent, for example, a method by which the amount of the charge controlling agent to be added to the resin particle constituting the toner particle. Such the method includes a method by which more amount of the charge controlling agent is added to the resin particle for constituting the near surface of the toner particle and the resin particles are aggregated so that the surface of the toner particle is constituted by resin particles containing no charge controlling agent, and a method by which the resin particles containing are aggregated and then thus prepared aggregated particles are each encapsulated by a resin component containing no charge controlling agent on the surface thereof.

It is preferable as the method for incorporating to the interior of the resin particle to mix the charge controlling agent with the binder resin and to control the diameter of the dispersed particles of the binder resin. However, the charge controlling agent may also be added into the aqueous phase so as to be taken into the toner in the aggregating process or the drying process when the charge controlling agent is dissolved out or released to the aqueous phase side.

External Additive

An inorganic fine particle is preferably used as the external additive for improving the flowing ability, developing ability and charging ability of the toner particle. The primary particle diameter of the inorganic fine particle is preferably from 5 to 2,000 nm, and particularly preferably from 50 to 200 nm. The size of the inorganic particle can be measured by a transmission electron microscope or a field-effect scanning electron microscope.

Concrete examples of the inorganic fine particle include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red ion oxide, antimony trioxide, magnesium oxide, zirconium oxide, barium sulfate, barium carbonate, silicon carbide, and silicon nitride.

Other than these, listed are polymer type micro-particles, for example, polystyrene, methacryl acid ester, acrylic acid ester copolymers, a polycondensation type such as silicone, benzoguanamine and nylon; as well as polymer particles prepared from thermally curable resin, which are prepared by soap-free emulsion polymerization, suspension polymerization or dispersion polymerization.

Such a fluidity providing agent can be subjected to a surface treatment to increase hydrohobicity and prevent deterioration of fluid characteristics and charging characteristics even under high humidity. For example, listed as a preferable surface processing agent can be such as a silane coupling agent, a silylization agent, a silane coupling agent having an alkylfluoride group, an organotitanate type coupling agent, an aluminum type coupling agent, silicone oil and modified silicon oil.

<<Dispersion Method of Resin particles>>

A method for dispersing resin particles into a water-based medium, which is performed during production of the toner according to the present invention, will now be described.

Methods for producing dispersion by dispersing resin particles into a water-based medium, which are performed in the present invention, are not particularly limited and include the following methods.

1. In cases of polyaddition of polyester resins and polyol resins, or condensation based resins, the following methods are listed:

(a) A method to produce a water-based dispersion of resin particles (A) in such a manner that precursors, (being monomers or oligomers) or solvent solutions thereof, are dispersed into a water-based medium in the presence of suitable dispersing agents and then hardened by the addition of hardening agents, (b) A method in which after dissolving suitable emulsifiers in precursors, (being monomers or oligomers) or solvent solutions (preferably in the liquid state, and may be liquidified by heating) thereof, phase inversion emulsification is performed by the addition of water.

(2) A method in which in the case of vinyl based resins, resin particles are formed employing a suspension polymerization method, an emulsion polymerization method, a seed polymerization method, and a dispersion polymerization method, or a water-based dispersion of the resulting particles are directly produced.

(3) A method in which resins previously prepared employing a polymerization reaction (may be any polymerization reaction mode such as addition polymerization, ring-opening polymerization, polyaddition, or addition condensation) are dispersed into a water-based medium.

(a) Resins prepared as above are pulverized employing a mechanical rotating system or a jet system pulverizer and resin particles are obtained by classifying resulting particles and thereafter, the resulting minute particle are dispersed into water in the presence of appropriate dispersing agents.

(b) A method in which a resinous solution prepared by dissolving the resins prepared as above is sprayed to form resin particles, and thereafter, the aforesaid resin particles are dispersed into water in the presence of suitable dispersing agents.

(c) A method in which resin particles are deposited by adding poor solvents to a resinous solution, prepared by dissolving the resins prepared as above to solvents, or by cooling a resinous solution which has been prepared by dissolving to solvent upon heated, and after obtaining the resin particles by removal of solvents, the resulting resin particles are dispersed into water in the presence of suitable dispersing agents.

(d) A method in which a resinous solution, prepared by dissolving the resins prepared as above in solvents, is dispersed into a water-based medium in the presence of suitable dispersing agents, and the solvents are then removed by vacuum or heating.

(e) A method in which suitable emulsifiers are dissolved in a resinous solution, prepared by dissolving the resins prepared as above in solvents, and thereafter, phase inversion emulsification is performed by the addition of water.

Simultaneously employed as emulsifiers or dispersing agents in the above methods are surface active agents (S), and water-soluble polymers (T). Further, simultaneously employed as emulsification and dispersing aids may be solvents (U) and plasticizers (V). Listed as specific examples are those disclosed in paragraphs 0036-0062 of JP-A 2002-284881.

<<Aggregation Method of Resin particles>>

The production method of the toner according to the present invention will now be described. As noted above, in the present invention, toner components such as binding resins, colorants, releasing agents, or charge control agents are dissolved in organic solvents and the resulting solution is mechanically dispersed into a water-based medium as an oil phase in the form of particles, whereby a minute particle dispersion comprised of toner components is formed. Subsequently, toner particles are formed via a process in which the minute particles in the aforesaid minute particle dispersion are aggregated.

As noted above, the present invention comprises a process in which resin particles are aggregated. The resin particles employed for aggregation, as described in the present invention, include those which contain organic solvents. For example, liquid droplets of the resinous solution are included in this category.

Listed as specific methods to prepare minute particles of each toner component in a water-based medium is one in which toner components are dissolved in organic solvents and pass through the process in which an oil phase is formed which functions as a dispersion phase in the water-based medium.

A liquid composition, comprised of organic solvents and necessary components, is usually stirred employing an impeller, and if desired has been subjected to thermal treatment, dissolution, or dispersion. In the water-based media, emulsification and dispersion are performed. During such operation, employed are homogenizers such as Homomixer (manufactured by Tokushu Kika Kogyo Co., Ltd.), Ebara Milder (manufactured by Ebara Corp.), and Clear Mix (M Technique Co.).

By controlling the amount and ratio of an oil phase formed by dispersing a single component, the rotation frequency during emulsification dispersion, and the time, it is possible to achieve the specified droplet diameter and size distribution. It is preferable that emulsification dispersion is performed so that the droplet diameter reaches ½-1/100 of its intended size.

The weight ratio of the components of each toner to the organic solvents is preferably selected between 1:10 and 1:1, while the weight ratio of the water-based medium to the oil phase into which the solution is dispersed is preferably selected between 10:1 and 1:1. However, ratios beyond these ranges are also acceptable.

Employed as water-based media may be water as well as combinations of water with partially water-compatible or infinitely water-compatible organic solvents, which include alcohols such as methanol or ethanol, ketone compounds such as methyl ethyl ketone, and esters such as ethyl acetate.

Organic solvents which are employed to dissolve or disperse the components of each toner are not particularly limited as long as they are insoluble or barely soluble in water or are partially soluble and dissolve the toner. Examples include toluene, xylene, benzene, carbon tetrachloride, methylene chloride, 1,2-dichloroethane, 1,1,2-trichloroethane, methyl acetate, ethyl acetate, methyl ethyl ketone, and methyl isobutyl ketone. They may be employed individually or in combinations of at least two types. Particularly preferred are aromatic solvents such as toluene or xylene, and halogenated hydrocarbons such as methylene chloride, 1,2-dichloroethane, chloroform, or carbon tetrachloride.

Listed as dispersing agents which are employed to emulsify-disperse the oil phase, which is a toner component, to the desired particle diameter in a water-based medium, are anionic surface active agents such as alkylbenzenesulfonates, α-olefinsulfonates, or phosphoric acid esters; cationic surface active agents such as alkylamine salts, aminoalcohol fatty acid derivatives, polyamine fatty acid derivatives, and amine salt types such as imidazoline; quaternary ammonium salt type cationic surface active agents such as alkyltrimethylammonium salts, dialkyldimethylammonium salts, alkyldimethylbenzylammonium salts, pyridinium salts, alkylisoquinolium salts, or benzethonium chloride; nonionic surface active agents such as fatty acid amide derivatives or polyhydric alcohol derivatives; and amphoteric surface active agents such as alanine, dodecyl-di(aminoethyl)glycine, di(octylaminoethyl)glycine, or N-alkyl-N, N-dimethylammonium betaine.

Further, it is possible to achieve the desired effects by employing surface active agents having a fluoroalkyl group, even in a very small amount. Listed as preferably employed anionic surface active agents having a fluoroalkyl group are fluoroalkylcaroxylic acids having 2-10 carbon atoms and metal salts thereof, disodium perfluorooctanesulfonylglutamate, sodium 3-[omega-fluoroalkyl (having 6-11 carbon atoms)oxy]-1-alkyl (having 3-4 carbon atoms) sulfonate, sodium 3-[omega-fluoroalkanoyl (having 6-8 carbon atoms)-N-ethylamino]-1-propnaesulfonate, fluoroalkyl (having 11-20 carbon atoms) carboxylic acid and metal salts thereof, perfluoroalkylcarboxylic acid (having 7-13 carbon atoms) and metal salts thereof, perfluoroalkyl (having 4-12 carbon atoms)sulfonic acid and metal salts thereof, perfluorooctanesulfonic acid diethanolamide, N-propyl-N-(2-hydroxyethyl)perfluorooctanesulfonamide, perfluoroalkyl (having 6-10 carbon atoms) sulfonamidopropyltrimethylammonium salts, perfluoroalkyl (having 6-10 carbon atoms)-N-ethylsulfonylglycine salts, and monoperfluoroalkyl (having 6-16 carbon atoms) ethylphosphoric acid esters.

Further, listed as cationic surface active agents are aliphatic primary, secondary, or tertiary amino acids, aliphatic quaternary ammonium salts such as a perfluoroalkyl (having 6-10 carbon atoms) sulfonamidopropyltrimethylammonium salt, a benzalconium salt, benzethonium chloride, a pyridinium salt, and an imidazolium salt.

Still further, employed as barely water-soluble inorganic dispersing agents may be tricalcium phosphate, calcium carbonate, titanium oxide, colloidal silica, and hydroxyapatite.

Still further, dispersed liquid droplets may be stabilized employing a polymer based protective colloid. Listed as specific compounds are acids and hydroxyl groups containing (meth)acryl based monomers, vinyl alcohol or vinyl alcohol and ethers, vinyl alcohol and esters of carboxyl group-containing compounds, homopolymers or copolymers of those having a nitrogen atom-containing or heterocyclic ring containing such as acrylamide, methacrylamide, or acid chlorides, and polymer based protective colloid forming compounds such as polyoxyethylene based compounds or celluloses, which are disclosed in JP-A No. 2002-296839.

In order to remove organic solvents from an emulsified dispersion, it is possible to accept a method in which organic solvents in liquid droplets are completely removed via evaporation by gradually heating the entire system. It is preferable that the operation is performed under reduced pressure because it is possible to lower the heating temperature. Lowering the heating temperature prevents toner components such as releasing agents from being dissolved in organic solvents, whereby abnormal aggregation, coalescence, and unification of the emulsified dispersion is minimized.

The organic solvent removing process may be performed prior to or after the aggregation process. Removal of organic solvents prior to the aggregation process enables enhancement of fusion and unification among minute particles after aggregation.

Listed as another processing method of those dissolved in organic solvents is a method in which an emulsified dispersion is sprayed into a dry ambience and water-insoluble organic solvents in liquid droplets are completely removed, whereby minute toner particles are formed, and simultaneously, water-based dispersing agents are removed by evaporation.

Generally employed as a dry ambience into which the emulsified dispersion is sprayed is a gas comprised of heated air, nitrogen, carbonic acid gas, or combustion gas, and especially various gas flows heated to higher than the boiling point of the solvent which has the highest boiling point among those used. The target quality is fully obtained by a short time process employing a spray drier, a belt drier, or a rotary kiln.

In the case in which minute particles are dispersed in water in a charged state, employed as aggregation methods are a method in which electrolytes are added to compress an electric double layer so that particles aggregate to each other, a method in which water-soluble polymers of a high molecular weight are adsorbed onto each particle to result in aggregation, a method in which substances, having a charge opposite that of the used surface active agents and dispersing agents, are added to neutralize the surface charge of minute particles, resulting in aggregation, and a method in which dispersion stability is degraded by varying the counter ions of adsorbing surface active agents or dispersing agents, or solubility of surface active agents or dispersing agents in a water-based medium by adding other substances to the water-based medium so that aggregation results.

It is possible to minimize blocking among toner particles during storage at high temperature, by providing releasing property to the produced toner during fixing by performing aggregation together with the above-mentioned releasing agent emulsion or minute resin particles having a polar group, by enhancing triboelectricity, or by arranging minute resin particles having a relatively high glass transition point in the exterior side.

Employed as electrolyte aggregating agents may be common inorganic or organic water-soluble salts represented by, for example, sodium sulfate, ammonium sulfate, potassium sulfate, magnesium sulfate, sodium phosphate, sodium dihydrogenphosphate, disodium monohydrogenphosphate, ammonium chloride, calcium chloride, cobalt chloride, strontium chloride, cesium chloride, barium chloride, nickel chloride, magnesium chloride, rubidium chloride, sodium chloride, potassium chloride, sodium acetate, ammonium acetate, potassium acetate, and sodium benzoate.

In the case in which univalent electrolytes are employed, their concentration is commonly in the range of 0.01-2.0 mol/L, is preferably in the range of 0.1-1.0 mol/L, and is more preferably in the range of 0.2-0.8 mol/L. When multivalent electrolytes are employed, the added amount is allowed to be less than the above.

When the aggregating agents are surface active agents, those described above may be employed, while when they are polymer based ones, of those which form polymer protective colloids, ones having an ultra-high molecular weight are suitable. Further, employed as substances which result in aggregation by degrading the dispersion stability due to the presence in water-based media may be ethanol, butanol, isopropanol, ethyl cellosolve, butyl cellosolve, dioxane, tetrahydrofuran, acetone, and methyl ethyl ketone, all of which are water-soluble organic compounds.

Further, by heating the dispersion after aggregation, it is possible to control the shape of formed toner particles. Toner particles tend to be spherical due to interfacial tension. However, at that time, it is possible to optionally control the particle shape from a sphere to an irregular shape by controlling heating temperature, toner viscosity, and the presence of organic solvents.

The resulting dispersion comprised of aggregated particles is sprayed into a dry ambience and water-insoluble organic solvents remaining in the aggregated particles are completely removed, whereby it is possible to form minute toner particles and simultaneously to remove water-based dispersing agents by evaporation. Commonly employed as a dry ambience into which the aggregated particle dispersion is sprayed is heated air, nitrogen, carbonic acid gas, or combustion gas, and especially various gas flows heated to higher than the boiling point of the solvent, which has the highest boiling point among those used. The target quality is fully obtained by a short time process employing a spray drier, a belt drier, or a rotary kiln. When an operation is repeatedly performed in which solid is separated from liquid prior to drying and re-dispersion (a re-slurrying) is performed by adding washing water, it is possible to remove most of the used dispersing agents and emulsifiers.

When compounds such as calcium phosphate, which are soluble in acid and alkali, are employed as a dispersion stabilizer, calcium phosphor is removed from the minute particles, employing a method in which after dissolving calcium phosphate in acid such as hydrochloric acid, washing is performed. As another method, it is possible to remove calcium phosphate by decomposition employing enzymes.

Generally, the particle size distribution after the aggregation operation is narrow and the resulting particles are employed as a toner without any modification. However, when the particle size distribution is broad, and washing and drying are carried out while maintaining the particle size distribution, it is possible to control the particles size distribution to that desired by classifying particles in an air flow.

Classification operation is performed in a liquid employing a cyclone, a decanter, or a centrifuge whereby it is possible to remove the minute particle portions. Naturally, the classification operation may be performed after yielding powder by drying. However, in view of efficiency, it is preferable that the classification is performed in a liquid. The resulting unnecessary minute particles or coarse particles may be returned to the liquid in which the toner components are dissolved so that they are used to form particles. The minute particles or coarse particles may be employed even though they are in a wet state. Dispersing agents employed in the aforesaid classification operation can be removed at the same time when the unnecessary minute particles are removed.

After drying the resulting toner powder may be blended with different kinds of particles such as minute releasing agent particles, minute static charge control agent particles, minute fluidizing agent particles, or minute colorant particles. Further, it is possible to minimize liberation of different kinds of particles from the surface of composite particles which are prepared in such a manner that different kinds of particles are fixed or fused on the surface by applying mechanical impact to the mixed powder.

Specific means include a method in which impact force is applied to the mixture employing blades rotating at a high rate and a method in which a mixture is charged into a high speed air flow and is accelerated so that each particle or composite particle is subjected to collision on a suitable collision board. Listed as such apparatuses are the ONGU Mill (manufactured by Hosokawa Micron Corp.), an apparatus which is prepared by modifying a Type I Mill (manufactured by Nippon Pneumatic Co.) to lower the crashing air pressure, the Hybridization System (manufactured by Nara Kikai Seisakusho), the Krypton System (manufactured by Kawasaki Heavy Industries, Ltd.), and an automatic mill.

<<Image Formation>>

An image forming apparatus which results in image formation, employing the toner according to the present invention, will now be described.

FIG. 1 is a schematic view showing one example of the image forming apparatus of the present invention. Numeral 34 is a photoreceptor drum which is a body to be charged, and comprises an aluminum drum base body having on the peripheral surface a photosensitive layer comprised of an organic photoconductor (OPC), while rotated in the arrowed direction at a specified rate.

In FIG. 1, based on information read by an original document reading unit (not shown), exposure radiation is emitted from semiconductor laser beam source 31. The exposure radiation is deflected vertically by polygonal mirror 32, with respect to the sheet surface of FIG. 1, and is irradiated onto the surface of the photoreceptor through fθ lens 33 which corrects image distortion, whereby latent images are formed. Photoreceptor drum 34 is previously uniformly charged by charging unit 35 and starts clockwise, rotation synchronized with exposure timing.

Incidentally, in the present invention, it is preferable that the aforesaid exposure is in the form of digital image exposure. However, analog image exposure may also be employed.

An electrostatic latent image on the surface of the photoreceptor drum is developed employing development unit 36, and the developed image, formed as above, is transferred onto transfer material 38, which has been synchronously conveyed by the action of transfer unit 37. Subsequently, transfer material 38 is separated from photoreceptor drum 34 employing separating unit 39 (being a separation pole), while the developed image is transferred onto and adhered to transfer material 38, conveyed to fixing unit 40, and subsequently fixed.

The non-transferred toner remaining on the photoreceptor surface is removed employing cleaning unit 41 utilizing a cleaning blade system, and the residual charge is eliminated by pre-charging light exposure (PCL) 42, and the photoreceptor is uniformly re-charged by charging unit 35 to prepare for subsequent image formation.

As noted above, the toner according to the present invention exhibits high toner particle strength and is subjected to strong negative chargeability, whereby it is particularly appropriate for image formation employing a non-magnetic single-component toner.

Figure 2:
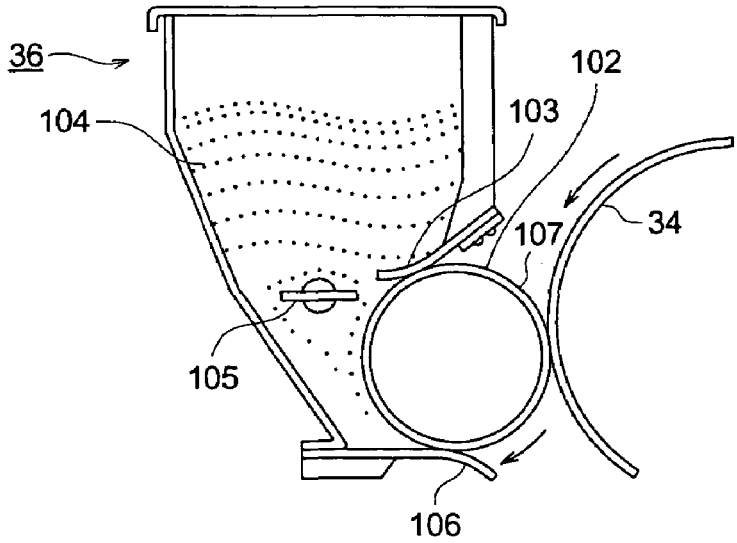
FIG. 2 is a cross-sectional constitutional view showing one example of a development unit employed for a non-magnetic single-component based developing agent.

FIG. 2 is a cross-sectional view showing one example of the structure of development unit 36 employed for a non-magnetic single-component developing agent, wherein 34 is a photoreceptor drum, 102 is a development roller, 103 is a elastic metal blade, 104 is a non-magnetic single-component toner, 105 is a stirring blade, 106 is a recovery plate, and 107 is a silicone resin. Incidentally, development roller 102 of which surface is covered by silicone resin 107 is used.

Figure 3:
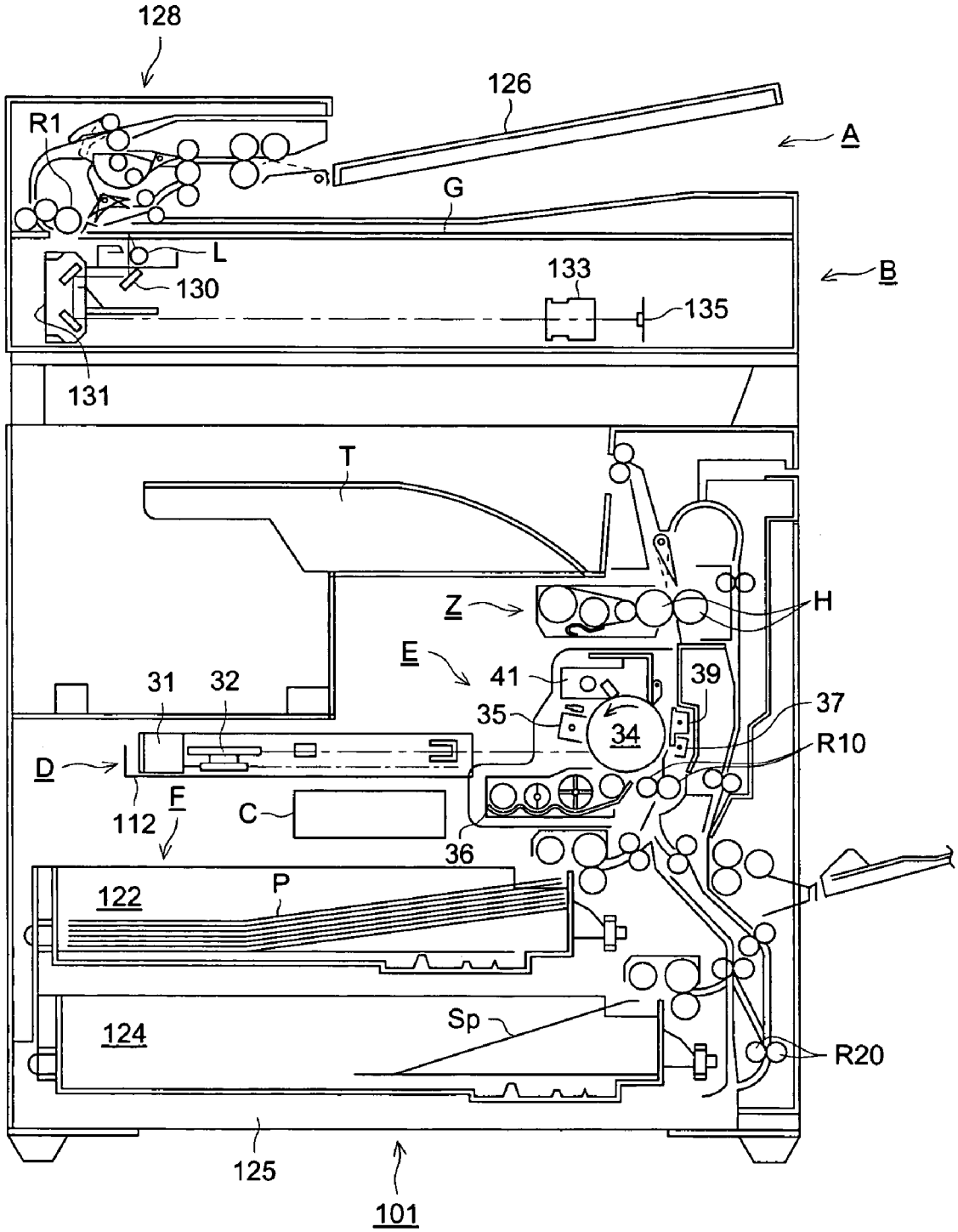
FIG. 3 is a schematic view of a digital image forming apparatus employing the toner according to the present invention.

It is possible to employ the present invention in an electrophotographic image forming apparatus, especially in an apparatus which forms electrostatic latent images on a photoreceptor employing a modulated beam which is modulated by digital image data from computers. FIG. 3 is a schematic view showing the structure of a digital image forming apparatus capable of using the toner according to the present invention.

In FIG. 3, image forming apparatus 101 comprises automatic original document feeding unit A (commonly called ADF), original document image reading section B which reads images from the original document fed by the automatic original document feeding unit, image control substrate C which processes the read original document images, writing section D comprising writing unit 112, which performs writing onto photoreceptor drum 34 as an image carrier, based on data after image processing, image forming section E which includes an image forming means such as photoreceptor drum 34, charging unit 35 on its periphery, development unit 36 comprised of a magnetic brush type development device, transfer unit 37, separating unit 39, and cleaning unit 41, and housing section F for paper feeding trays 122 and 124 which house recording paper P.

Automatic document feeding unit A is comprised of main components of original document placement platen 126 and original document feeding and processing section 128 comprising a group of rollers including roller R1 and a switching means (no reference figure) which switches feeding channel of original documents as required.

Original document reading section B is located under platen glass G and is comprised of two mirror units 130 and 131 capable of reciprocating movement while maintaining light path length, fixed focusing lens (hereinafter referred simply to as a lens) 133, and linear imaging element (hereinafter referred to as CCD) 135, while writing section D is comprised of laser beam source 31 and polygonal mirror (being a deflecting unit) 32.

Viewed from the moving direction of recording paper P as a transfer material, R10 shown on the front side of transfer unit 37 is a registration roller, while H on the downstream side of separating unit 39 is a fixing means.

In a practical embodiment, fixing means H is comprised of a roller having a heating source in its interior and a pressure contact roller which rotates while brought into pressure contact with the aforesaid roller.

Further, Z is a cleaning means for fixing means H and is mainly comprised of a cleaning web which is arranged to be woundable.

An original document (not shown) placed on original document placement platen 126 is conveyed by original document feeding and processing section 128 and is subjected to exposure employing exposure means L during passing under roller R1.

Reflected light from the original document is focused on CCD 135 through mirror units 130 and 131 as well as lens 133 located in a fixed position, and subsequently read.

Image information read at original document image reading section B is processed by the image processing means, subjected to encoding, and stored in the memory arranged on image control substrate C.

Further, image data are retrieved corresponding to image formation and based on the aforesaid image data, laser beam source 31 in writing section D is driven, whereby exposure is performed on photoreceptor drum 34.

In recent years, in the fields of electrophotography and the like in which an electrostatic latent image is formed on a photoreceptor, and a visible image is formed by developing the resulting latent image, research and development of image forming methods have increasingly been performed which employ digital systems in which improvement of image quality, conversion and editing are easily carried out, and it is possible to attain high quality images.

As scanning optical systems in which optical modulation is performed employing digital image signals from the computer employed in this image forming method and the apparatus or the original document for copying, available are apparatuses such as one in which an acoustic optical modulator is placed in the laser optical system, and optical modulation is performed employing the aforesaid acoustic optical modulator, and another apparatus in which semiconductor laser beams are employed and the laser intensity is directly modulated. From these scanning optical systems, spot exposure is performed on the uniformly charged photoreceptor to form images comprised of dots.

The beams emitted from the aforesaid scanning optical systems result in a circular or elliptical luminance distribution similar to a normal distribution having an oblong shape. For example, in the case of laser beams, dot shapes either in the primary scanning direction or in the secondary scanning direction, or in both directions are circular or elliptical having a narrow size as 20-100 μm.

It is possible to apply the present invention not only to form monochromatic images but also to form full color images. For example, listed is an image forming method in which a plurality of image forming units is provided and in each image forming unit, each of the different visible color image (being toner images) is formed, whereby a full color toner image is formed.

The toner according to the present invention is suitably applied to an image forming method which comprises a fixing process in which an image forming support carrying a toner image is fixed by passing between the heating roller and the pressure roller which constitute a fixing unit.

Figure 4:
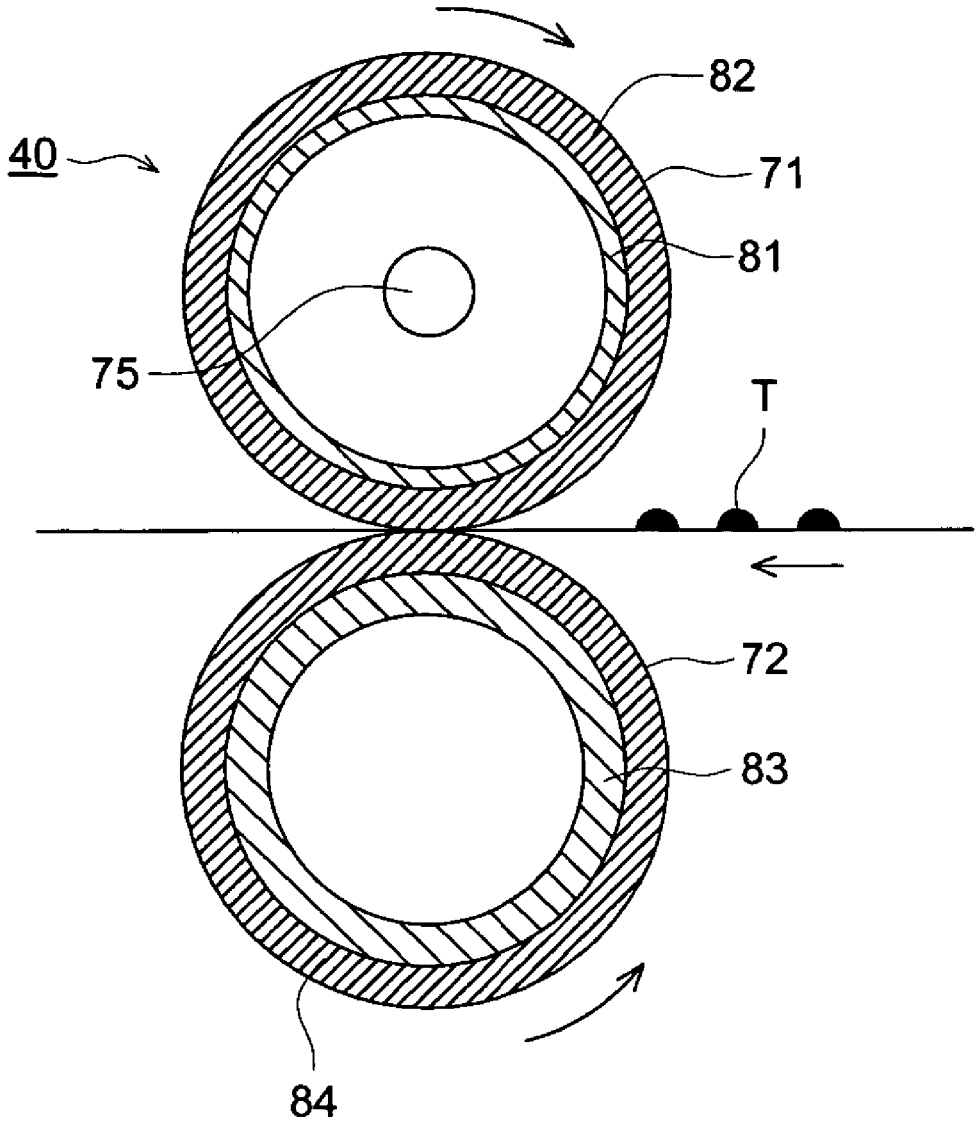
FIG. 4 is a schematic cross-sectional view of a fixing unit employing the toner according to the present invention.

FIG. 4 is a cross-sectional view of one representative example of a fixing unit employed in the image forming method employing the toner according to the present invention. Fixing unit 40 in FIG. 4 comprises heating roller 71 and pressure roller 72 which is brought into contact with the aforesaid roller. T in FIG. 4 is a toner image formed on transfer paper (being an image forming support).

Heating roller 71 comprises cored cylinder 81 covered with layer 82 comprised of fluororesins or a plastic body, and includes in the interior heating member 75 comprised of a linear heater.

Cored cylinder 81 is comprised of metal, and its interior diameter is 10-70 mm. Metals which constitute cored cylinder 81 are not particularly limited, and include, for example, iron, aluminum, or copper, and alloys thereof.

The wall thickness of cored cylinder 81 is commonly 0.1-15 mm and is determined considering the balance between energy savings (a decrease in thickness) and strength (depending on constituted materials). For example, in order to achieve the strength obtained by a 0.57 mm thick cored iron cylinder by substituting an aluminum cored cylinder, it is required to use the wall thickness of 0.8 mm. A fixing roller comprised of a cored cylinder of a lower wall thickness disclosed in JP-A No. 2001-51536 is preferably employed.

Listed as specific fluororesins which may constitute covering layer 82 are PTFE (polytetrafluoroethylene) and PFA (tetrafluoroethylene-perfluoroalkyl vinyl ether copolymers). The thickness of covering layer 82, when fluororesins are employed, is commonly 50-700 μm, and is preferably 70-600 μm.

Further, listed as an elastic body for covering layer 82 is high heat resistant silicone rubber and silicone sponge rubber such as LTV, RTV, and HTV. The Asker strength of elastic bodies which constitute covering layer 82 is commonly less than 80 degrees, and is preferably less than 60 degrees. Further, the thickness of covering layer 82 comprised of the elastic body is commonly 0.1-30 mm, and is preferably 0.1-20 mm.

Listed as heating member 75, which is appropriately employed as a linear heater, is a halogen heater.

Pressure roller 72 comprises cored cylinder 83 having thereon covering layer 84 comprised of an elastic body. The elastic body which constitutes covering layer 84 is not particularly limited, and includes various types of soft rubber such as urethane rubber or silicone rubber as well as sponge rubber.

Asker C hardness of the elastic body which constitutes covering layer 84 is commonly 40-80 degrees, is preferably 45-75 degrees, and is more preferably 50-70 degrees. Further, the thickness of covering layer 84 is commonly 0.1-30 mm, and is preferably 0.1-20 mm. Materials which constitute cored cylinder 83 are also not particularly limited, and include metals such as aluminum, iron and copper, and alloys thereof.

Contact load (being a total load) between heating roller 71 and pressure roller 72 is commonly 40-350 N, is preferably 50-300 N, and is more preferably 50-250 N. The aforesaid contact load is specified considering the required strength (the wall thickness of cored cylinder 81) of heating roller 71. For example, in the case of a heating roller comprised of an iron cored cylinder of a wall thickness of 0.3 mm, it is preferable to allow the contact load to be a maximum of 250 N.

Further, in view of off-setting resistance as well as fixability, it is preferable to set nip width between 4 and 10 mm. Still further, it is preferable to control nip surface pressure between $0.6\times10^5$ and $1.5\times10^5$.

Specific fixing conditions in the fixing unit shown in Table 4 are, for example, a fixing temperature (being the surface temperature of heating roller 71) of 150-210° C. and a linear fixing rate of 230-900 mm/second, whereby it is possible to achieve excellent fixing performance.

EXAMPLES

The present invention will now be further described with reference to the examples described below. In the following description, "parts" is parts by weight, and "%" is % by weight.

Preparation of Resin Solution 1 (Polyester Resin)

Charged into a reaction vessel fitted with a cooling pipe, a stirrer, and a nitrogen inlet tube were 103 parts of bisphenol A ethylene oxide 2 mol addition product, 240 parts of bisphenol A propylene oxide 2 mol addition product, 133 parts of terephthalic acid, 16.5 parts of 1,6-hexamethylenedicarboxylic acid, 16.5 parts of trimellitic acid, and 2 parts of butylene oxide. The resulting mixture underwent reaction at normal pressure and 230° C. for 8 hours and further reaction for 5 hours under a reduced pressure of 1.33-1.99 Pa (10-15 mmHg). Thereafter, the reaction product was cooled to 110° C., whereby Polyester (1) at a peak top molecular weight of 9,500 and an Mw/Mn of 1.9 was obtained.

Subsequently, 280 parts of Polyester (1) were mixed with and dissolved in a solvent mixture consisting of 1,900 parts of ethyl acetate and 100 parts of n-butanol, whereby Resin Solution 1 was obtained. Tg of the resinous component in Resin Solution 1 was 44° C.

| Preparation of Toner 1 | |
|---|---|
| "Resin Solution 1" (at a Tg of the resinous component of 44° C.) | 100,000 parts |
| Water-containing carbon black cake (50% solids in the water-containing cake) | 12,000 parts |
| Charge control agent (Spiron Black TRH, manufactured by Hodogaya Chemical Co., Ltd.) | 1,000 parts |
| Carnauba wax (Carnauba Wax No. 1 in flakes, manufactured by S. KATO & Co.) | 10,000 parts |

The above materials were dispersed in a mixture of 0.04 parts of myristylyl butyl ketone and 200,000 parts of xylene, by rolling a ball mill filled with zirconia beads, whereby an oil phase which became a dispersion phase was prepared.

Separately, 700,000 parts of ion-exchanged water, and 1,000 parts of sodium dodecylbenzenesulfonate were stirred and dispersed, whereby an aqueous phase which became a continuous phase was prepared. An oil phase was charged into the aqueous phase while stirring, employing a Homomixer (manufactured by Tokushu Kika Kogyo Co., Ltd.), whereby oil droplets of a volume average particle diameter of 1 μm were prepared. Thereafter, solvents (ethyl acetate, butanol, and xylene) were distilled out under reduced pressure at 50° C. for 2 hours, whereby a blackish gray emulsion was obtained.

The resulting dispersion was transferred to a stirring tank fitted with an impeller, and aggregated particles were formed by gradually dripping, while stirring, an aqueous solution prepared by dissolving 10,000 parts of aluminum sulfate in 10,000 parts of ion-exchanged water. Thereafter, the resulting composition was maintained at 70° C., whereby the resulting aggregates were subjected to unification and fusion. The resulting composition was partly sampled and observed employing a scanning type electron microscope.

Thereafter, stirring was performed at 95° C. for 8 hours. When the circularity of toner particles reached 0.963, the temperature was lowered to 40° C. and stirring was terminated.

Thereafter, washing and filtration were repeated, and the resulting cake was dried under reduced pressure for 8 hours, whereby black particles were obtained. Subsequently, 100 parts of the resulting colored particles, 0.8 part by weight of acicular titanium oxide (at a major axis of 120 nm, being subjected to an n-decyltrimethoxysilane treatment), 1.8 parts by weight of spherical monodipsersed silica (at a primary particle diameter of 137 nm, silica sol, prepared by a sol gel method, was subjected to a hexamethyldisilazane treatment, dried, and crushed), and 0.8 part by weight of silica particles (at a primary particle diameter of 14 nm), which were prepared by a vapor phase method and were subjected to an octylmethoxysilane treatment, were blended employing a Henschel mixer and coarse particles and aggregates were removed by passing though a 50 μm opening sieve, whereby Toner 1, which was a non-magnetic single-component developing agent, was obtained.

Herein, it was confirmed that the circularity of the toner particles did not vary after the addition of the aforementioned external agents.

Further, volatile components incorporated in Toner 1 were quantitatively analyzed employing the gas chromatograph method based on the above-mentioned head space system.

Preparation of Toner 2

Toner 2 was prepared in the same manner as Toner 1, except that in the production process, 0.04 part of myristylyl butyl ketone was replaced with 0.08 part of myristylyl methyl ketone.

Preparation of Toner 3

Toner 3 was prepared in the same manner as Toner 1, except that in the production process, the carnauba wax was replaced with Carnauba Wax No.2 (in flakes) manufactured by S. KATO & Co.

Preparation of Toner 4

Toner 4 was prepared in the same manner as Toner 1, except that in the production process, the carnauba wax was replaced with Carnauba Wax No.3 (in flakes) manufactured by S. KATO & Co.

Preparation of Toner 5

Toner 5 was prepared in the same manner as Toner 1, except that in the production process, "Resin Solution 1" was replaced with "Resin Solution 2" which was prepared by dissolving the polyol resin obtained by the steps described below.

Preparation of Resin Solution 2 (Polyol Resin)

Placed in the above-mentioned reaction vessel were 378 parts of a low molecular weight bisphenol A type epoxy resin (of a number average molecular weight of approximately 360), 86 parts of a high molecular weight bisphenol A type epoxy resin (of a number average molecular weight of approximately 2,700), 191 parts of the diglycidylated product of a bisphenol A type propylene oxide addition product, 274 parts of bisphenol F, 70 parts of p-cumylphenol, and 200 parts of xylene.

Under a flow of nitrogen, the resulting mixture was heated between 70 and 100° C., and 0.183 g of lithium chloride was added. Thereafter, the resulting mixture was heated to 160° C. and xylene was distilled out under reduced pressure. Subsequently, polymerization was performed at a reaction temperature of 180° C. for 6-9 hours, whereby Polyol Resin (1) at a softening point of 109° C., and a Tg of 58° C. was obtained.

Subsequently, 1,000 parts of the above "Polyol Resin (1)" were mixed with, and dissolved in a solvent mixture consisting of 1,900 parts of ethyl acetate and 100 parts of butanol, whereby "Resin Solution 2" was obtained.

Preparation of Toner 6

Toner 6 was prepared via the same production process as Toner 2, except that the above-mentioned Polyol Resin (1) was used.

Preparation of Toner 7

Toner 7 was prepared in such a manner that in the production process of Toner 5, the carnauba wax was replaced with Carnauba Wax No.2, manufactured by S. KATO & Co. Incidentally, distillation at 50° C. under reduced pressure was changed to distillation under normal pressure.

Preparation of Toner 8

Toner 8 was prepared in the same manner as Toner 7, except that the carnauba wax was replaced with Carnauba Wax No.3, manufactured by S. KATO & Co.

Preparation of Toner 9

Toner 9 was prepared in the same manner as the above-mentioned Toner 1, except that in the production process, the amount of myristyryl butyl ketone was changed to 0.4 parts.

Preparation of Toner 10

Toner 10 was prepared in the same manner as the above-mentioned Toner 2, except that in the production process, the amount of myristyryl butyl ketone was changed to 0.8 parts.

Preparation of Toner 11

Toner 11 was prepared in the same manner as Toner 3, except that in the production process, the amount of myristyryl butyl ketone was changed to 0.4 parts.

Preparation of Toner 12

Toner 12 was prepared in the same manner as Toner 4, except that in the production process, the amount of myristyryl butyl ketone was changed to 0.4 parts.

Preparation of Toners 13-16

Toners 13 and 14 were prepared in such a manher that in the production process of above-mentioned Toner 1 and 2, polypropylene wax, which was an olefin based wax, was added instead of carnauba wax in the same amount, and further no myristyryl butyl ketone or myristyryl methyl ketone was added. In the same manner, Toners 14 and 16 were prepared in such a manner that in the production process of Toners 7 and 8, polypropylene wax was employed.

Table 1 shows resulting Toners 1-8, as well as Toners 9-16 which are non-magnetic single-component developing agents.

The resulting prints were evaluated based on the criteria described below.

A: even strongly written text on the gray frame, employing a dip pen, caused no toner to peel off B: strongly written text on the gray frame employing a dip pen, caused some toner to peel off, while when a ball-point pen was used, no toner peeled off.

C: fixing was insufficient, and when the gray frame was manually held, the toner peeled off to stain fingers <Generation of Microscopic Spots on Extra-Thick Paper Sheet>

A 10 percent halftone image was formed on the entire image area of the 490th to the 495th postcard described above. Subsequently, the resulting dot image was observed employing a hand magnifying lens and formation of microscopic spots near the dots was observed.

A: no microscopic spots were detected

B: a few microscopic spots were present in such a level that only when carefully observed, their presence was detected C: obvious microscopic spots were detected

TABLE 1

| | Content of Volatile Component Comprised of Ketones (ppm) | Content of Ethyl Acetate (ppm) | Content of Butanol (ppm) | Content of Xylene (ppm) | Total Content of Volatile Components (ppm) | Average Value of Circularity | Average Value of Equivalent Circular Diameter (μm) | Slope of Circularity to Equivalent Circular Diameter |
|---|---|---|---|---|---|---|---|---|
| Toner 1 | 7.1 | 6.1 | 5.2 | 1.0 | 20.4 | 0.990 | 4.9 | −0.025 |
| Toner 2 | 12.2 | 5.2 | 4.7 | 0.1 | 23.6 | 0.992 | 4.8 | −0.028 |
| Toner 3 | 30.1 | 6.0 | 4.9 | 0.6 | 50.1 | 0.985 | 5.1 | −0.018 |
| Toner 4 | 55.2 | 5.8 | 4.9 | 0.8 | 67.8 | 0.981 | 2.6 | −0.046 |
| Toner 5 | 8.1 | 4.9 | 5.0 | 0.2 | 21.2 | 0.991 | 5.0 | −0.022 |
| Toner 6 | 18.3 | 5.2 | 5.1 | 0.4 | 30.1 | 0.992 | 5.1 | −0.031 |
| Toner 7 | 36.2 | 48.0 | 43.1 | 85.2 | 277.1 | 0.984 | 4.9 | −0.040 |
| Toner 8 | 57.4 | 48.1 | 43.2 | 85.2 | 298.1 | 0.980 | 7.4 | −0.013 |
| Toner 9 | 63.9 | 5.0 | 5.0 | 1.0 | 75.0 | 0.981 | 7.7 | −0.008 |
| Toner 10 | 73.6 | 5.1 | 4.9 | 0.9 | 83.1 | 0.981 | 7.8 | −0.007 |
| Toner 11 | 70.7 | 5.1 | 4.9 | 0.7 | 82.6 | 0.978 | 7.7 | −0.053 |
| Toner 12 | 78.8 | 5.2 | 4.9 | 0.6 | 91.4 | 0.981 | 7.8 | −0.060 |
| Toner 13 | — | 5.2 | 4.8 | 0.4 | 30.5 | 0.988 | 7.9 | −0.008 |
| Toner 14 | — | 5.1 | 4.7 | 0.3 | 31.0 | 0.978 | 7.5 | −0.005 |
| Toner 15 | — | 48.1 | 43.3 | 85.2 | 305.3 | 0.973 | 7.7 | −0.055 |
| Toner 16 | — | 49.0 | 43.2 | 85.4 | 308.9 | 0.981 | 7.8 | −0.059 |

Values shown in Table 1 are obtained by measuring toners which have been prepared through washing, a filtration process, and a drying process under reduced pressure. Further, based on measurements, it was confirmed that DSC exotherm due to carnauba wax was in the range of 8.8-9.2 J/g.

Evaluation was performed employing an apparatus which was constituted in such a manner that the image forming apparatus performing digital exposure shown in FIG. 1 was loaded with the development unit employing non-magnetic single-component developing agents shown in FIG. 2. Further, the fixing unit employed for image formation was constituted as shown in FIG. 4.

<Fixability on Extra-Thick Paper Sheets>

The image forming apparatus shown in FIG. 1 was used for performing evaluation, and 500 thick postcards (at a thickness of 0.4 mm), manufactured by Heart Co., Ltd., were continuously printed. A gray frame at a relative density of 0.5 was printed on each of the postcards in the frame portion.

<Fixability onto Offset Printing Paper>

Printing was performed on 250 sheets of paper for paperback (60.2 g paper, for offset printing, medium quality: non-coated paper), manufactured by Daio Paper Corp. Subsequently, all the printed sheets were turned over 10 times using the thumb of one hand, and bleeding stain near characters was observed directly and by employing a handy magnifying lens, and evaluated based on the criteria below.

A: no bleeding stain was noted

B: bleeding stains were not visible to the naked eye but were noted through observation employing a magnifying lens, however resulting in no problems for commercial viability C: Traces of the thumb were stained resulting in black bleeding <Unpleasant Odor during Image Formation>

Ten operators engaged in shortrun printing were assigned as monitors to evaluate unpleasant odor in the fixing section when a black area ratio of 12 percent image was continuously printed on 5,000 A4 sheets.

A: at least 8 of the 10 persons sensed no unpleasant odor

B: at least 6 of the 10 persons noted a slight odor, but not being unpleasant

C: at least 5 of 10 persons complained of discomfort due to unpleasant odor

<Unpleasant Odor during Bookbinding>

Ten persons ranging in age from 10 to 50, who had been randomly selected, evaluated generation of unpleasant odor while turning pages of image of outputted materials which had been subjected to bookbinding for monitoring. Bookbinding was performed employing 250 sheets (500 pages) having a black area ratio of 12 percent image of on each page, which were cut to B6 size.

A: at least 8 of the 10 persons sensed no unpleasant odor

B: at least 6 of the 10 persons noted slight odor, but not unpleasant

C: at least 5 of the 10 persons complained of discomfort due to unpleasant odor

<Evaluation of Formation of Toner Blisters>

Images were formed on plain paper (at 46 g/cm$^2$ of paper) to result in a toner adhesion amount of 1.6 mg/cm$^2$, and the presence in the images of pores at a size of 0.1-0.5 μm, namely toner blisters, was visually observed and evaluated based on the criteria below.

A: no generation of toner blisters was noted

B: one or two toner blisters were present per 4 cm$^2$ but were at a level of no problem for commercial viability at least 3 toner blisters per 4 cm$^2$ were clearly noted, and were ranked to be at a level of no commercial viability Table 2 shows the results.

TABLE 2

| | Fixing ability | | Odor | Odor | | |
|---|---|---|---|---|---|---|
| | Thick Paper | Offset Printing Paper | during image formation | during book binding | Toner blister | Powder genaration |
| Example 1 | A | A | A | A | A | A |
| Example 2 | A | A | A | A | A | A |
| Example 3 | B | A | B | B | B | B |
| Example 4 | B | B | B | B | B | B |
| Example 5 | A | A | A | A | A | A |
| Example 6 | A | A | A | A | A | A |
| Example 7 | B | A | B | B | B | B |
| Example 8 | B | B | B | B | B | B |
| Example 9 | C | C | C | C | C | C |
| Example 10 | C | C | C | C | C | C |
| Example 11 | C | C | C | C | C | C |
| Example 12 | C | C | C | C | C | C |
| Example 13 | C | C | B | B | C | C |
| Example 14 | C | C | B | B | C | C |
| Example 15 | C | C | B | B | C | C |
| Example 16 | C | C | B | B | C | C |

As can clearly be seen from the results in Table 2, the toners according to the present invention formed toner images exhibiting excellent fixing strength on thick paper such as invitation cards or thick postcards. Further, it was confirmed that even though large load was applied to the toners, the toner particles were not crushed.

Further, it was confirmed that when toner images were formed on offset printing paper, toner images exhibiting excellent fixing strength were obtained, and in addition, no generation of toner blisters was detected.

On the other hand, it was confirmed that when images were formed on thick paper or offset printing paper employing toners as a sample, it was not possible to achieve the fixing strength obtained by the toners according to the present invention, and also problems of toner blistering occurred.

The invention claimed is:

1. A toner for an electrophotography comprising a resin and a colorant, which is formed by a process including a step of aggregating resin particles, wherein the toner comprises a ketone compound which is volatile at 170° C. in an amount of 4-60 ppm and carnauba wax in toner particles.

2. The toner of claim 1, wherein the toner further comprises a component which is volatile at 170° C., and a total amount of the ketone compound and the component which is volatile at 170° C. is in 20-300 ppm.

3. The toner of claim 1, wherein resin particles are amorphous polyester resin particles.

4. The toner of claim 1, wherein an average value of circularity of toner particles is 0.94-0.98, the average value of an equivalent circle diameter is 2.6-7.4 μm.

5. The toner of claim 1, wherein slope of the circularity with respect to the equivalent circular diameter is from −0.050 to −0.010.

6. The toner of claim 1, wherein the toner comprises, silica or titanium particles having a primary particle diameter of 50-200 nm.

7. The toner of claim 1, wherein the ketone compound is represented by

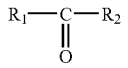

wherein $R_1$ and $R_2$ each represent an alkyl group having 1-25 carbon atoms, which may have a substituent, or a phenyl group.

8. The toner of claim 1, wherein an acid value of the carnauba wax is at most 10.0.

9. The toner of claim 8, wherein an acid value of the carnauba wax is 0.1-8.0.

10. The toner of claim 8, wherein an acid value of the carnauba wax is 0.4-6.0.

11. The toner of claim 1, wherein a saponification value of the carnauba wax is to 70-95.

12. The toner of claim 1, wherein melting point of the carnauba wax is 75-90° C.

13. The toner of claim 1, wherein the amount of the carnauba wax is 1-30 percent by weight based on the toner.

14. The toner of claim 13, wherein the amount of the carnauba wax is 2-20 percent by weight based on the toner.

15. The toner of claim 14, wherein the amount of the carnauba wax is 3-15 percent by weight based on the toner.

16. The toner of claim 1, wherein the resin particles are prepared by addition polymerization or condensation polymerization reaction.

* * * * *